US006160231A

United States Patent [19]

Kaufman

[11] Patent Number: 6,160,231

[45] Date of Patent: Dec. 12, 2000

[54] BUTTON RETENTION FEATURE

[75] Inventor: Dennis Kaufman, Hamilton, Ill.

[73] Assignee: Methode Electronics, Inc., Chicago, Ill.

[21] Appl. No.: 09/454,332

[22] Filed: Dec. 3, 1999

[51] Int. Cl.[7] ..... H01H 3/00

[52] U.S. Cl. ..... 200/339; 200/401

[58] Field of Search ..... 200/339, 401, 200/438, 439, 409, 408

[56] References Cited

U.S. PATENT DOCUMENTS

| | | | |
|---|---|---|---|
| 4,440,994 | 4/1984 | Nat | 200/42 T |
| 4,755,645 | 7/1988 | Naoki et al. | 200/340 |
| 4,831,223 | 5/1989 | Wako | 200/517 |
| 4,985,605 | 1/1991 | Valenzona | 200/528 |
| 5,710,397 | 1/1998 | Liao | 200/5 A |
| 5,850,062 | 12/1998 | Botz et al. | 200/315 |
| 5,920,042 | 7/1999 | Gotoh | 200/5 R |

*Primary Examiner*—Michael L. Gellner
*Assistant Examiner*—Nhung Nguyen
*Attorney, Agent, or Firm*—Karl D. Kovach; David L. Newman

[57] ABSTRACT

A pivot switch assembly including a button and a housing. The housing includes a trunion and a retaining wall. The trunion opposes the retaining wall and forms a receiving gap between the two features. The button includes a rib. The rib has an aperture. The rib of the button being positioned into the receiving gap of the housing. The trunion of the housing then engages the aperture of the rib of the button so as to provide a pivoting function for the switch assembly. The geometry of the button and housing prevents the button from becoming dislodged during periods of high acceleration, such as during deployment of an airbag.

17 Claims, 4 Drawing Sheets

BUTTON RETENTION FEATURE

BACKGROUND OF THE INVENTION

1. Field of the Invention

The present invention pertains to a button of a switch assembly, where the switch assembly is of the rocking or pivoting type of switch assembly. The invention more particularly concerns the retention of the button in the switch assembly during application of external forces or impact loading to the switch assembly.

2. Discussion of the Background

Switch assemblies are well known in the art where a button pivotally mounts to a housing. Automotive manufacturers are increasingly integrating many functions, such as switches, on the steering column, on stalks projecting outward from the steering column, and on the steering wheel. Such placement of switch assemblies is ergonomically desirable.

Automotive component manufacturers are under pressure from the leaders of the automotive industry to provide components which are considered to be safe during a crash of an automobile. Safe-type components are typically covered with a soft, foam-like material. Another solution is to prevent components from becoming dislodged and flying about the cabin area of the automobile. Flying components can cause serious injuries to the occupants of the cabin area. During a crash or collision, the components are subject to large de-acceleration levels. Also, during deployment of an airbag, components mounted on the steering wheel are subject to large acceleration levels. Currently, automobile manufacturers are investigating the possibility of reducing the magnitude of the force used to deploy airbags, since the deployment force is so large and is capable of causing injury to the occupants of the cabin. Such examples clearly illustrate the potential for injury to occupants when components become dislodged. Thus, there is great demand for components which do not become dislodged when subject to the acceleration levels experienced during deployment of an airbag or during a crash.

Furthermore, the automobile manufacturers require that the solution to such a problem be inexpensive and easy to install. To-date, no prior art solution exists that is economical to manufacture and easy to install, while being resistant to large levels of acceleration. Most switch assemblies employ trunions that engage with pivot holes. Where either the pivot hole or the trunion can be located on the button and the other of the two features is located on the housing. Typically, the trunion feature displaces the rib containing the pivot hole feature. Then the trunion snaps into place with the pivot hole feature. High impact forces can dislodge the button from the housing, since the rib having the pivot hole can deflect and become dismounted from the trunion. Attempts have been made to ensure the retention of the button by increasing the stiffness of the parts so that when they snap together they do so with greater force. However, increasing the stiffness of the parts has led to the overstressing of the parts during assembly thus leading to failure of the parts. An inexpensive switch is one that can elastically snap together, however, the fact that the parts must flex enough during assembly, limits the rigidity of the elastic members. Such requirements adversely effect the retaining abilities of the switch assembly.

Thus, there is a need for an inexpensive, reliable, button of a switch assembly that can be easily mounted on a steering wheel of an automobile and where the button will not become dislodge during deployment of an airbag located in the steering wheel.

SUMMARY OF THE INVENTION

Therefore, it is an object of the present invention to provide a pivot switch assembly which is inexpensive to manufacture, easy to install, and robust enough so as to prevent the button from being dislodged when subject to large accelerations.

In one form of the invention, the pivot switch assembly includes a button and a housing. The housing has a first trunion and a first retaining wall. The first trunion being positioned oppositely the first retaining wall so as to form a first receiving gap between the two features. The button having a first rib. The first rib having an aperture. The first rib being positioned in the first receiving gap of the housing. The first trunion engages the aperture of the first rib of the button so as to provide the pivot action.

In another form of the invention a method is set forth for assembling the pivot switch assembly which includes the steps of inserting a rib of a button into a receiving gap of a housing, the receiving gap being formed between a retaining wall of the housing and a trunion of the housing; elastically deforming the trunion of the housing; and introducing the trunion of the housing into an aperture of the rib of the button so that the trunion enters the aperture and becomes undeflected.

Thus, Applicants' invention provides a pivot switch assembly which is inexpensive to manufacture, easy to install, and which resists the button from being dislodged from the housing. These and other features of the invention are set forth below in the following detailed description of the presently preferred embodiment.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PRESENTLY PREFERRED EMBODIMENT

Figure 1:
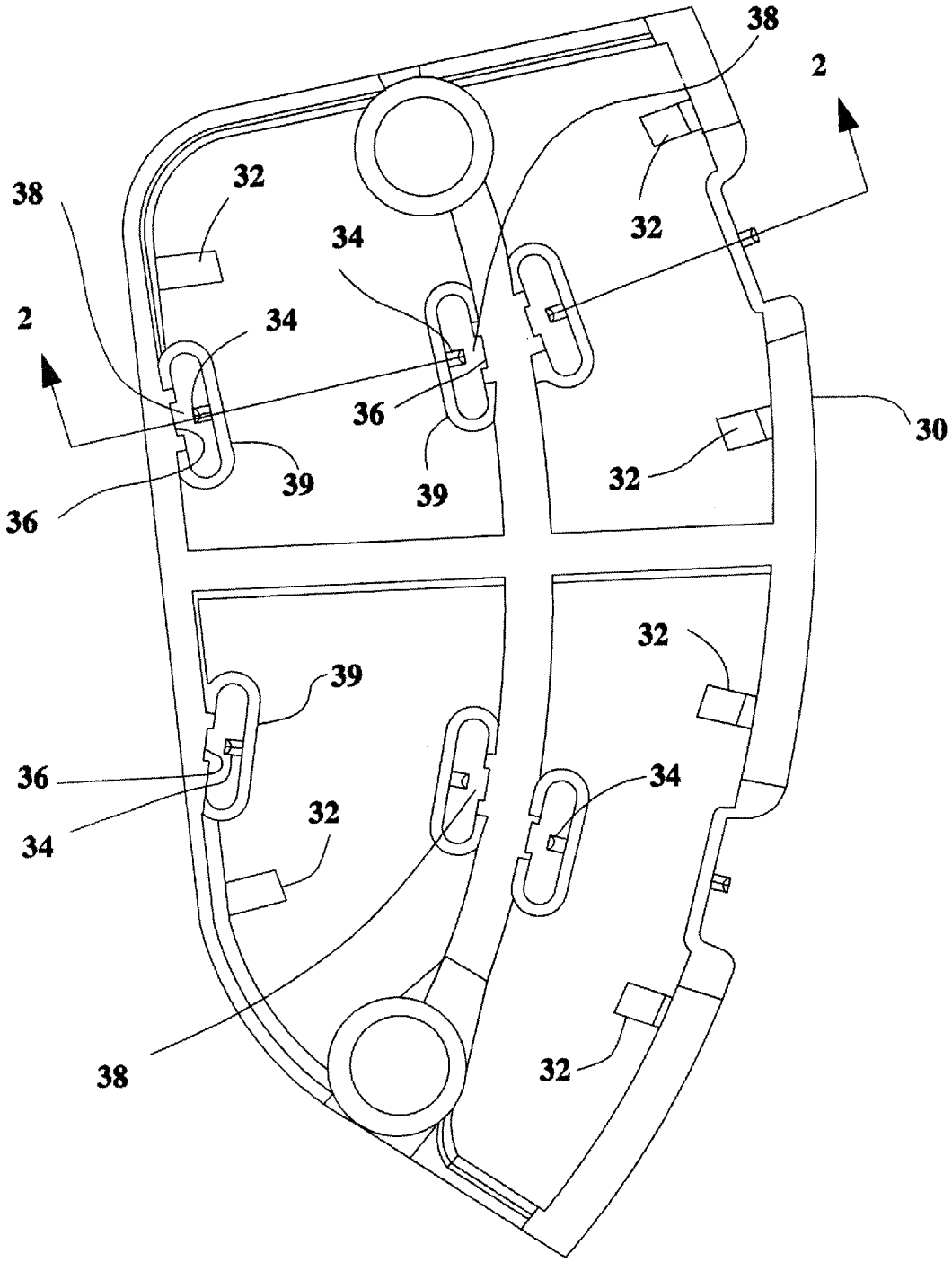
FIG. 1 is a top plan view of a switch housing with the button removed of the present invention.
Figure 2:
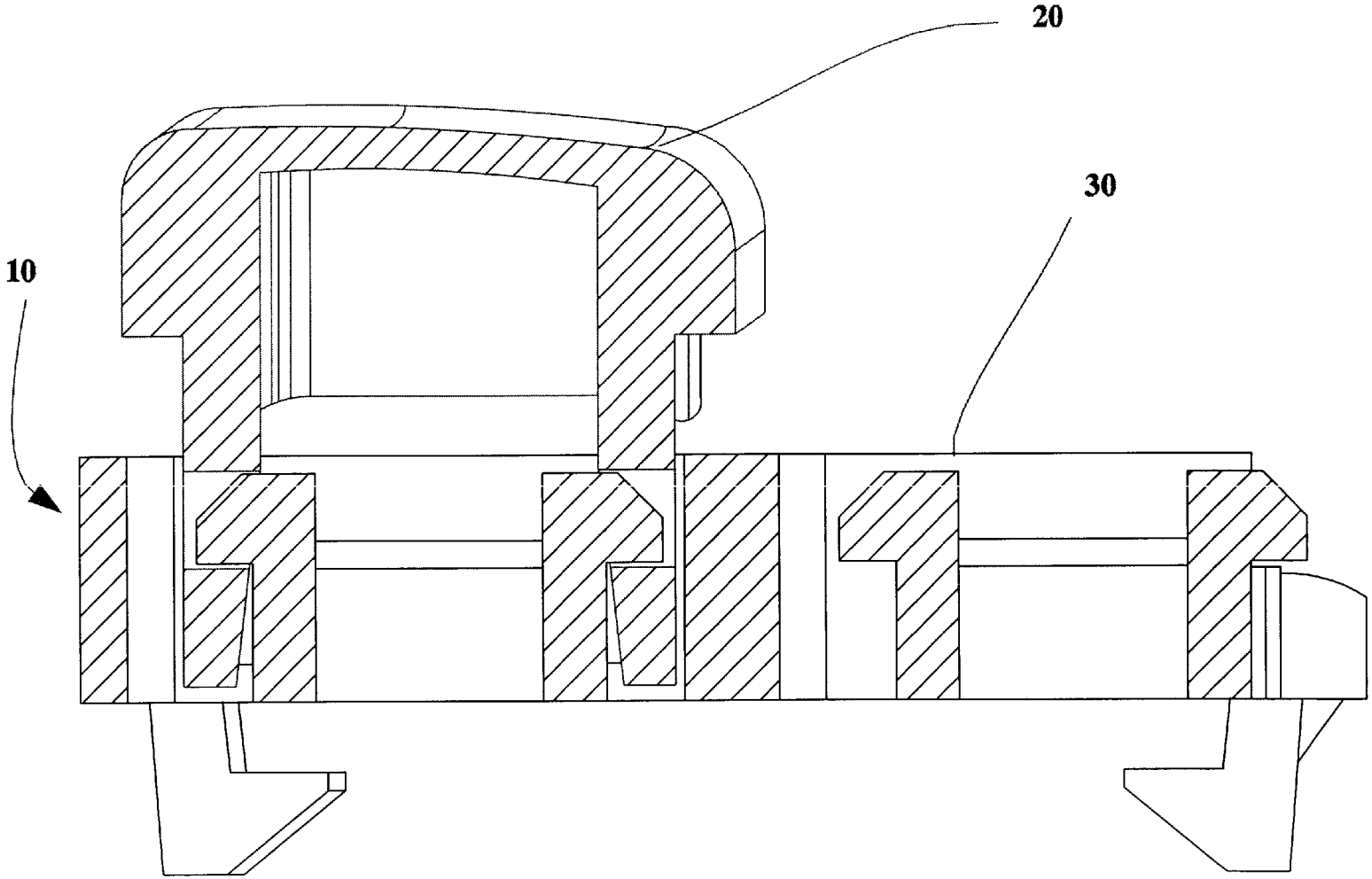
FIG. 2 is a cross-sectional view of the switch housing and button taken along section line 2—2 of FIG. 1.

Referring now to the drawings, wherein like reference numerals designate identical or corresponding parts throughout the several views, and more particularly to FIGS. 1–4 thereof, a first embodiment of the present invention is a switch assembly 10 having a button 20 and a housing 30 (FIG. 2).

FIG. 1 is a top plan view of a housing 30 of a switch assembly. The housing 30 includes mounting tongues 32, trunions 34, trunion support walls 39 for attaching the trunions 34 to the housing 30, retaining walls 36 opposing each trunion 34, receiving gaps 38 located between each trunion 34 and each retaining wall 36. Preferably, the ends of the trunions 34 have a circular shape. The housing 30 is, preferably, made of a polymer material. The trunions 34 and trunion support walls 39 are designed so as to provide a mounting structure that is capable of being elastically deflected relative to the rest of the housing.

FIG. 2 is a cross-sectional view of the switch assembly 10 taken along section line 2—2 of FIG. 1. FIG. 2 further displays the button 20, which is not shown in FIG. 1, and the housing 30.

Figure 3:
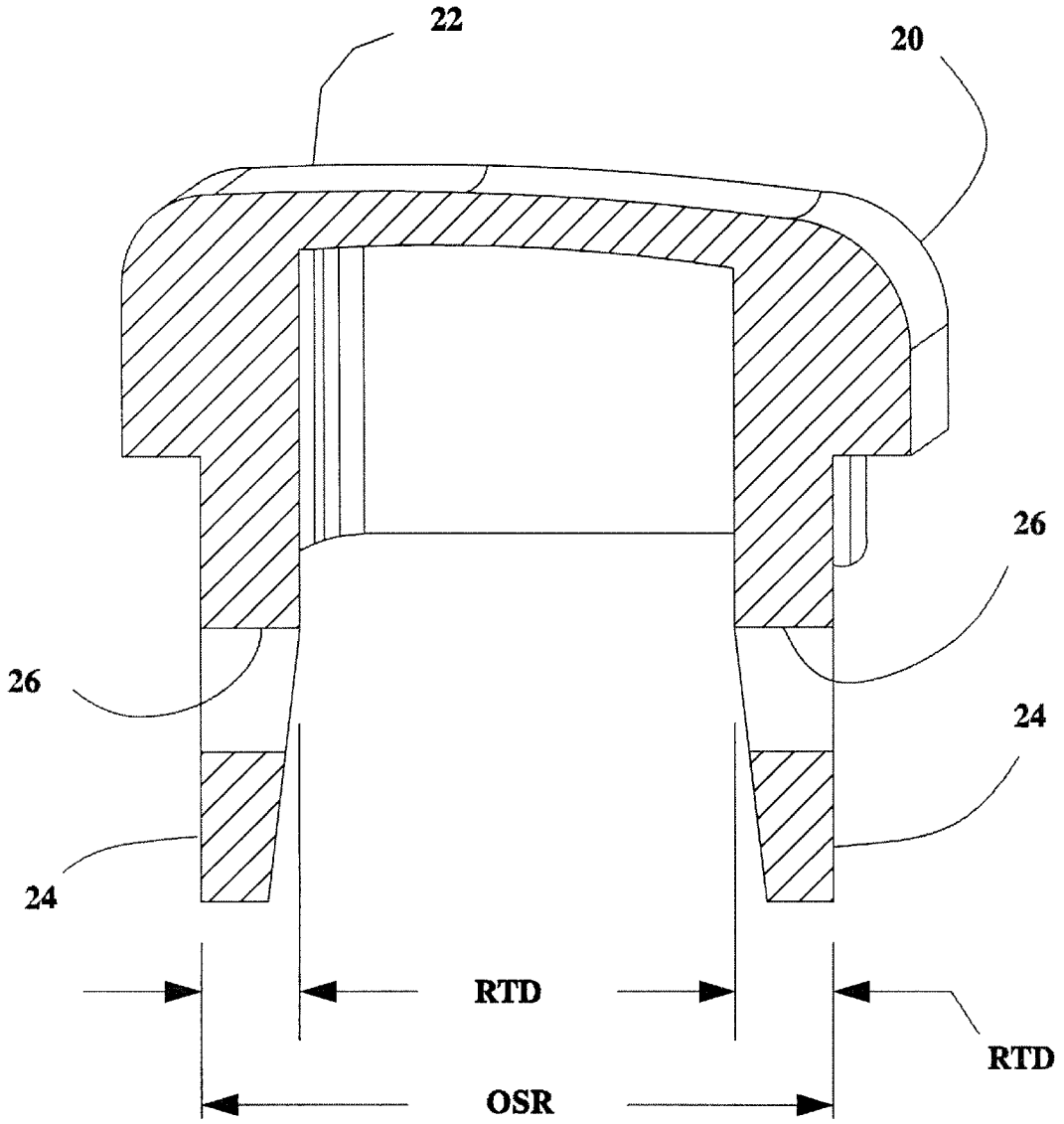
FIG. 3 is a cross-sectional view of the button of FIG. 2.

FIG. 3 is a cross-sectional view of the button 20 of FIG. 2. The button 20 includes an actuation surface 22, ribs 24, and an aperture 26 located in each rib 24. Preferably, the apertures 26 have a circular shape. Each rib 24 has a thickness dimension denoted as RTD. Outer surfaces of the ribs 24 are separated by a distance dimension denoted as OSR or a second distance. The button 20 is, preferably, constructed of a polymer material. The ribs 24 arc designed so that they do not deflect substantially relative to the actuation surface 22 or relative to the trunions 34.

Figure 4:
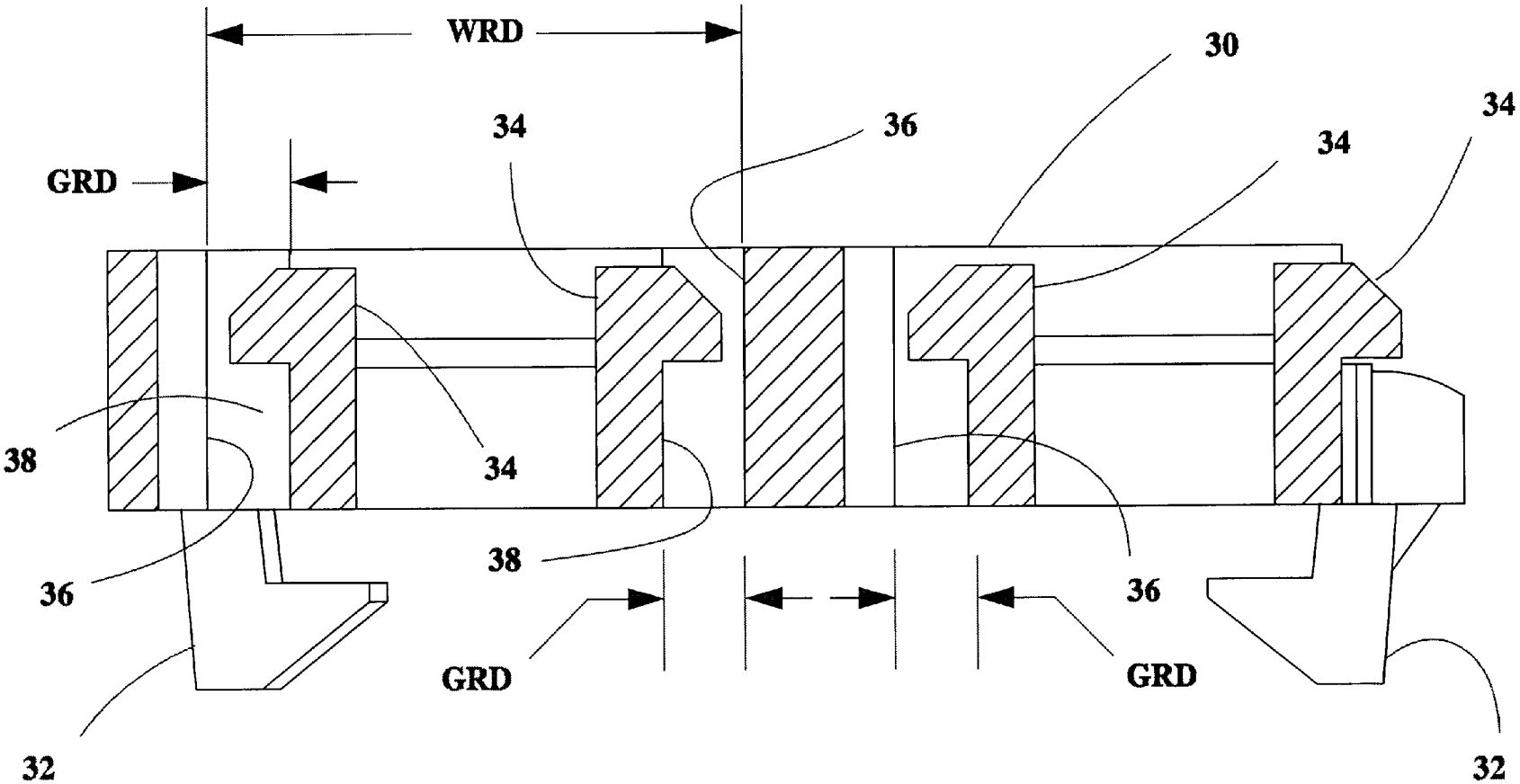
FIG. 4 is a cross-sectional view of the switch housing of FIG. 2.

FIG. 4 is a side view of the housing 30 from FIG. 2. FIG. 4 shows the mounting tongues 32 used to mount the housing to, for example, a steering wheel. Also, shown are the trunions 34, where each trunion 34 is separated from the opposing retaining wall 36 by the receiving gap 38. The receiving gap 38 is shown to have a distance dimension denoted as GRD. Opposing retaining walls 36 are separated by a distance dimension denoted as WRD or a first distance.

In practice, the button 20 is inserted into the housing 30 so as to form the switch assembly 10 (see FIG. 2). To insert the button 20, the ribs 24 are placed next to the trunions 34 of the housing 30. A force is then applied to the actuation surface 22 of the button 20 so as to urge the button 20 towards the housing 30. The trunions 34 and ribs 24 are beveled so that the parts will slide by and relative to each other as the ribs 24 enter the receiving gap 38. As the two ribs 24 of a button 20 pass by the two trunions 34 of the housing 30, the two trunions 34 elastically deflect inwards toward each other, while the ribs 24 do not deflect appreciably. That is, the ribs 24 are stiffer than the trunions 34. Once the trunion 34 is aligned with the aperture 26, the trunion 34 becomes undeformed and enters the aperture 26. That is, the trunion 34 snaps into place. When the trunion 34 is in such a position, the button 20 is in the correct position. As such, the end of the trunion 34 is positioned within the aperture 26 of the rib 24, as shown in FIG. 2. The circular aperture 26 is larger than the circular end of the trunion 34 and allows for relative motion between the two parts. The circular end of the trunion 34 has a length that is substantially the same as the distance dimension GRD, but slightly less. Specifically, the button 20 pivots relative to the housing 30 thus forming the switch assembly 10 having rocking or pivoting motion.

The width dimension GRD of the receiving gap 38 is substantially the same as, but slightly greater than, the thickness dimension RTD of the rib 24. Also, preferably, the distance dimension WRD of the housing 30 is substantially the same as, but slightly larger than, the distance dimension OSR of the button 20. Testing has shown that such clearances between the parts 20, 30 provides for ease of assembly of the button 20 to the housing 30, relative motion between the button 20 and the housing 30, and essentially makes it improbable that the button 20 will be dislodged from the housing 30 during exposure to explosive type acceleration levels experienced during the deployment of an airbag.

During a violent acceleration, the trunions 34 and the retaining walls 36 of the housing 30 prevent the ribs 24 of the button 20 from being dislodged. The rib 24 is securely engaged with the trunion 34 and the retaining wall 36. The retaining wall 36 opposing the trunion 34 of the housing 30 secures the button 20. The displacement of the trunion 34 out of the aperture 26 of the rib 24 becomes extremely difficult and the interface between the two parts becomes much more rigid and can withstand greater impact forces and accelerations as compared to other switch assemblies. Provided the button 20 and the housing 30 are made of the same material, and hence they both have the same density, it can be seen from the figures that a given acceleration level will generate a larger force on the large mass of the button than it will on the small mass of the trunion. Therefore, the trunion will not deflect very much. Thus, Applicants' invention provides an inexpensive to manufacture, and easy to install button retention feature for a switch assembly that retains the button during periods of exposure to large accelerations.

Obviously, numerous modifications and variations of the present invention are possible in light of the above teachings. It is therefore to be understood that within the scope of the appended claims, the invention may be practiced otherwise than as specifically described herein.

What is claimed is:

1. A pivot switch assembly comprising:

a housing having a first trunion and a first retaining wall, the first trunion located in opposition to the first retaining wall so as to form a first receiving gap therebetween; and a button having a first rib, the first rib having an aperture, the first rib of the button being positioned in the first receiving gap of the housing, and wherein the first trunion of the housing engages the aperture of the first rib so as to provide pivot action, and wherein the housing includes a first trunion support wall, the first trunion support wall attaching to the first trunion and to the housing so as to provide an elastically deformable base for the first trunion.

2. The pivot assembly of claim 1 wherein the button is substantially rigid.

3. The pivot assembly of claim 2 wherein the button has an actuation surface.

4. The pivot switch assembly of claim 3 wherein the housing is made of a polymer.

5. The pivot switch assembly of claim 4 wherein the button is made of a polymer.

6. The pivot switch assembly of claim 1 wherein the housing has a second trunion and a second retaining wall, the second trunion located in opposition to the second retaining wall so as to form a second receiving gap therebetween, and wherein the button has a second rib having an aperture, the second rib of the button being positioned in the second receiving gap of the housing, and wherein the second trunion of the housing engages the aperture of the second rib.

7. The pivot switch assembly of claim 1 wherein the housing includes a second trunion support wall, the second trunion support wall attaching to the second trunion and to the housing so as to provide an elastically deformable base for the second trunion.

8. The pivot switch assembly of claim 7 wherein the housing is made of a polymer.

9. The pivot switch assembly of claim 8 wherein the button is made of a polymer.

10. The pivot assembly of claim 9 wherein the button is substantially rigid.

11. The pivot assembly of claim 10 wherein the button has an actuation surface.

12. The pivot assembly of claim 11 wherein the first retaining wall and the second retaining wall are separated by a first distance, and wherein outer surfaces of the first rib and the second rib are separated by a second distance, and wherein the first distance is greater than the second distance.

13. The pivot switch assembly of claim 12 wherein the second distance is substantially the same as the first distance.

14. The pivot switch assembly of claim 11 wherein the first receiving gap has a width being greater than a thickness of the first rib of the button.

15. The pivot switch assembly of claim 14 wherein the thickness of the first rib of the button is substantially the same as the width of the first receiving gap.

16. A method of assembling a pivot switch assembly, the method comprising the steps of:

inserting a rib of a button into a receiving gap of a housing, the receiving gap being formed between a retaining wall of the housing and a trunion of the housing;

elastically deflecting the trunion of the housing; and introducing the trunion of the housing into an aperture of the rib of the button so that the trunion enters the aperture and becomes undeflected.

17. The method of claim 16, further comprising the step of pushing on an actuation surface of the button.

* * * * *